US005938573A

United States Patent [19]

Davies, III et al.

[11] Patent Number: 5,938,573

[45] **Date of Patent: *Aug. 17, 1999**

[54] STRETCH THERAPY APPARATUS FOR PHYSICAL FITNESS, REHABILITATION AND MEDICAL TREATMENT

[76] Inventors: D. Robert Davies, III, 10250 Dakins Dr., Richmond, Va. 23236; David Dise, 8532 Waxford Rd., Richmond, Va. 23235

[ * ] Notice: This patent is subject to a terminal disclaimer.

[21] Appl. No.: 08/787,570

[22] Filed: Jan. 22, 1997

Related U.S. Application Data

[63] Continuation of application No. 08/459,666, Jun. 2, 1995, Pat. No. 5,626,547, which is a continuation of application No. 08/231,067, Apr. 22, 1994, Pat. No. 5,529,560, which is a continuation-in-part of application No. 08/073,945, Jun. 8, 1993, Pat. No. 5,421,801.

[51] Int. Cl.[6] ..... A63B 23/035

[52] U.S. Cl. ..... 482/131; 482/133; 482/907; 601/24; 601/33

[58] Field of Search ..... 482/10, 72, 91, 482/92, 94, 95, 96, 97, 100, 131, 133–139, 130, 114, 123, 142, 907, 908; 601/23, 24, 33–36; 606/241–243; 5/646, 647; 297/69, 183.9, 188.01, 188.04, 188.05, 188.2, 188.21, 344, 466, DIG. 10

[56] References Cited

U.S. PATENT DOCUMENTS

| | | | |
|---|---|---|---|
| 3,126,071 | 3/1964 | Basset | 482/95 |
| 4,494,750 | 1/1985 | Smith | 482/142 |
| 4,569,519 | 2/1986 | Mattox et al. | 482/135 |
| 4,786,051 | 11/1988 | Mullican | 482/112 |
| 4,844,453 | 7/1989 | Hestilow | 482/112 |

FOREIGN PATENT DOCUMENTS

| | | | |
|---|---|---|---|
| 326426 | 1/1985 | Germany | 482/101 |

*Primary Examiner*—Jeanne M. Clark
*Attorney, Agent, or Firm*—Whitham, Curtis & Whitham

[57] ABSTRACT

A stretch therapy apparatus is disclosed which provides for enhanced physical fitness as well as rehabilitation and medical treatment. The stretch therapy apparatus includes both a leg stretching component and an arm and back stretching component. The leg stretching component allows the user to easily and safely separate his or her legs by 180° or more using hand crank or motorized mechanisms. Sliding leg deck construction reduces the pressure on the user's knees during leg stretching exercises. The arm and back stretching component allows the user to maintain his or her arms and back muscles in a fully extended position without applying undue force during stretching. The arm and back stretching component includes a platform on which the user is seated and a stretching pole which can be selectively oriented in three dimensional space relative to the user's waist. In one configuration, the user grasps a handle bar that moves along the length of the stretching pole and is held in position when the user's arms are fully extended. Alternatively, in another configuration, the user grasps one pair of a plurality of ladder like rungs positioned incrementally along the length of the stretching pole.

10 Claims, 19 Drawing Sheets

STRETCH THERAPY APPARATUS FOR PHYSICAL FITNESS, REHABILITATION AND MEDICAL TREATMENT

CROSS-REFERENCE TO RELATED APPLICATIONS

This application is a continuation application of the co-pending patent application having U.S. Ser. No. 08/459,666, filed Jun. 2, 1995 now U.S. Pat. No. 5,626,547, which itself is a continuation application of U.S. Ser. No. 08/231,067, filed Apr. 22, 1994, now U.S. Pat. No. 5,529,560, which itself is a continuation-in-part (CIP) application of the application having U.S. Ser. No. 08/073,945, filed Jun. 8, 1993 now U.S. Pat. No. 5,421,801, and the complete contents of these applications are herein incorporated by reference.

BACKGROUND OF THE INVENTION

1. Field of the Invention

The invention is generally related to an apparatus for safely facilitating stretching exercises and rehabilitation. More particularly, the invention is directed to a stretch therapy apparatus that allows stretching of a wide variety of muscle groups without undue stress.

2. Description of the Prior Art

A physically fit person is defined by a combination of strength, endurance, and flexibility. Many individuals concentrate on strength and endurance by engaging in activities such as weight lifting and jogging, but ignore the need to be flexible. However, it is widely recognized by experts in the field that stretching prior to commencing an exercise regimen is of paramount importance to reduce the likelihood of exercise related injuries. This is particularly true with regard to martial arts regimens which demand optimum flexibility for swift, wide-ranged, muscle group movements. Furthermore, lack of flexibility can lead to problems with the lower back, etc., as a person ages.

Stretching is also an important part of any physical therapy regimen practiced by patients undergoing physical rehabilitation following an accident or illness, as well as patients seeking relief from common ailments such as back pain. This type of therapy is commonly supervised by a highly trained physical therapist, and may be conducted in a hospital setting or at the patient's home. Paraplegic and quadriplegic patients must also have their limbs stretched on a regular basis to avoid further medical complications. For severely impaired patients, the therapist must maneuver the patient's limbs through a full range of motion while at the same time being careful not to force or over stretch the muscles.

Traditionally, pre-exercise, post-exercise, as well as therapeutic stretching exercises are performed on the floor using a simple floor mat, or by hanging from a bar. In a typical floor stretching exercise, a person sits with his legs in a straddle position extended out in front of his torso. The person bends his torso into the mat, thereby stretching his leg and back muscles. To maximize the stretch, the person may extend his arms straight out over his head in a reaching fashion and the stretch is held for a short period of time. The stretching exercise may be assisted with the help of a partner or therapist For severely impaired patients, a therapist must individually move each of the patient's limbs while the patient is on a table or on the floor. In a hanging stretch exercise, the person hangs from a bar, such as, for example, in a chin-up preparation position, and allows the weight of his or her own body to provide a downward stretch. This method is particularly undesirable in a therapeutic environment since the full body weight often provides many times more force than is necessary or desired to accomplish the stretch, thus putting strain on the muscles. Additionally, a patient in therapy often lacks the strength in their hands that is required to support their own body weight.

To date, few advances have been made in the design of machines which facilitate stretching exercises. Typical examples can be found in U.S. Pat. No. 4,844,453 to Hestilow, U.S. Pat. No. 5,108,090 to Reed, U.S. Pat. No. 4,445,684 to Ruff, and U.S. Pat. No. 5,137,504 to Mangini.

It is important that stretching be carried out with smooth continuous movements, rather than bouncy movements, in order to avoid injuries during the stretching exercise itself. Ideally, the muscles should be in a relaxed state to maximize the stretch and to avoid undue stress on the muscle, tendons, and skeleton. In addition, stretching a wide variety of muscle groups will maximize the benefit to the user. Having a machine designed to accomplish these objectives would be advantageous since it would encourage healthy individuals to include stretching in their fitness routine, and would aid in rehabilitation and medical treatment regimens as well as reduce the cost of therapy.

SUMMARY OF THE INVENTION

It is an object of this invention to provide a stretch therapy apparatus useful for physical fitness, rehabilitation, and medical treatment.

According to the invention, a stretch therapy apparatus provides safe and effective stretching of a wide variety of muscle groups while the user is in a relaxed sitting or prone orientation. The stretch therapy apparatus includes a mechanism for stretching the back and arm muscles without using the weight of the patient to apply the stretching force. The back and arm muscles can be stretched with the user's torso oriented at any inclination with respect to his or her legs. For example, the user is permitted to stretch above his head as well as towards his or her feet. In addition, the back and arm muscles can be stretched with the user's torso being turned towards one or the other of his or her legs, thus stretching a different set of muscle groups than are stretched when the torso is oriented in a forward direction. The stretch therapy apparatus also includes a mechanism for stretching the user's thigh, calf, and foot muscles. The user's legs are oriented on a pair of leg decks which can be comfortably opened and closed to 180° or more. The leg decks can be oriented such that they project directly in front of the user's waist or at an incline above or below the user's waist. The leg decks can also be adapted to reduce the pressure on the user's knees as they are opened and closed, and can be folded to allow for hamstring stretching. Foot supports are used to orient the user's toes relative to his ankle, thus providing calf stretching. All stretching mechanisms can be motorized, controlled by hand crank, or be provided by stationary, incrementally spaced ladder rungs. Indicia are provided for positive feedback to the user, as well as to provide a trainer or therapist with stretching assessment information.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
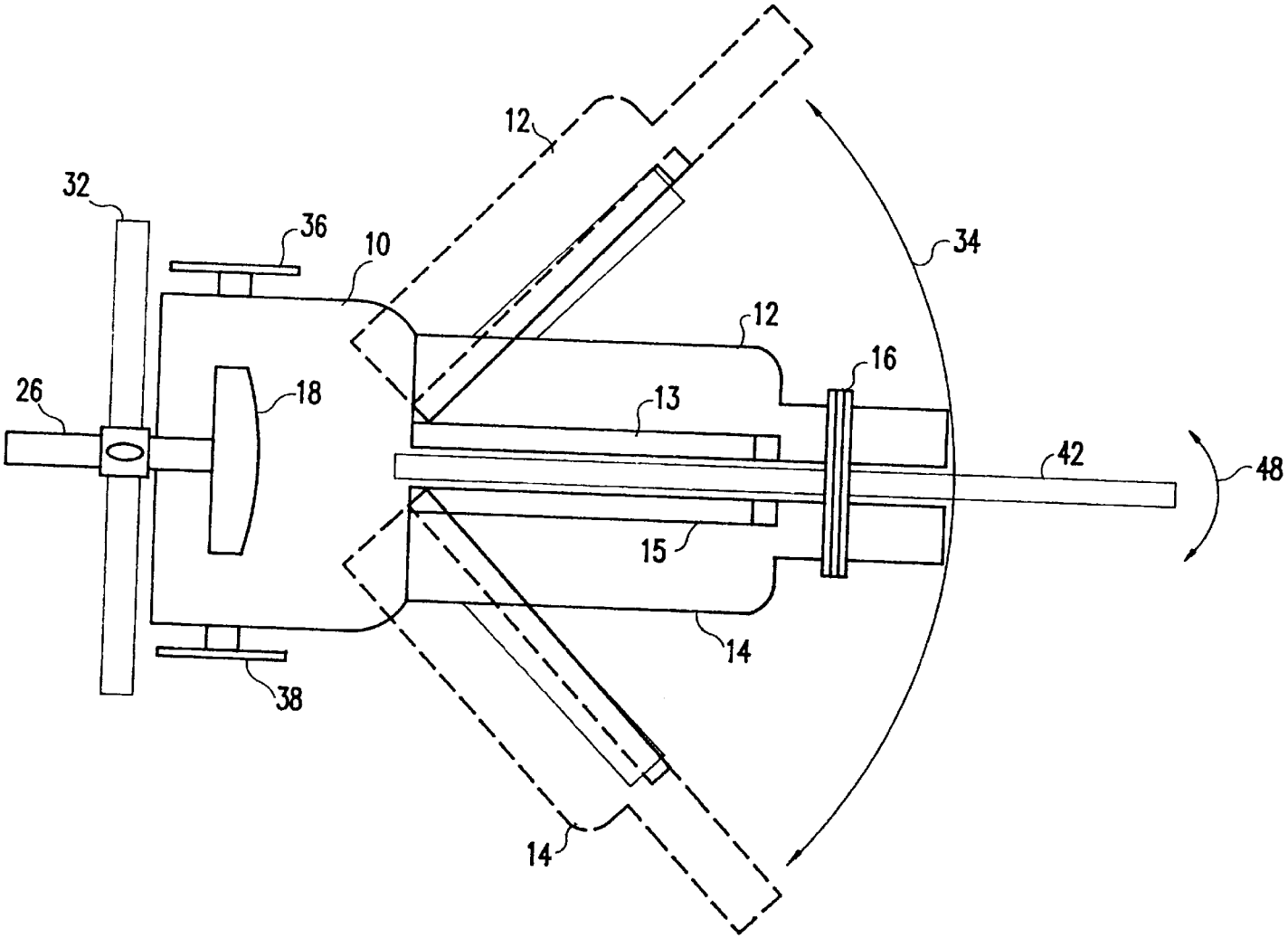
FIG. 1 is a plan view of a stretch therapy apparatus according to a first embodiment of this invention.
Figure 2:
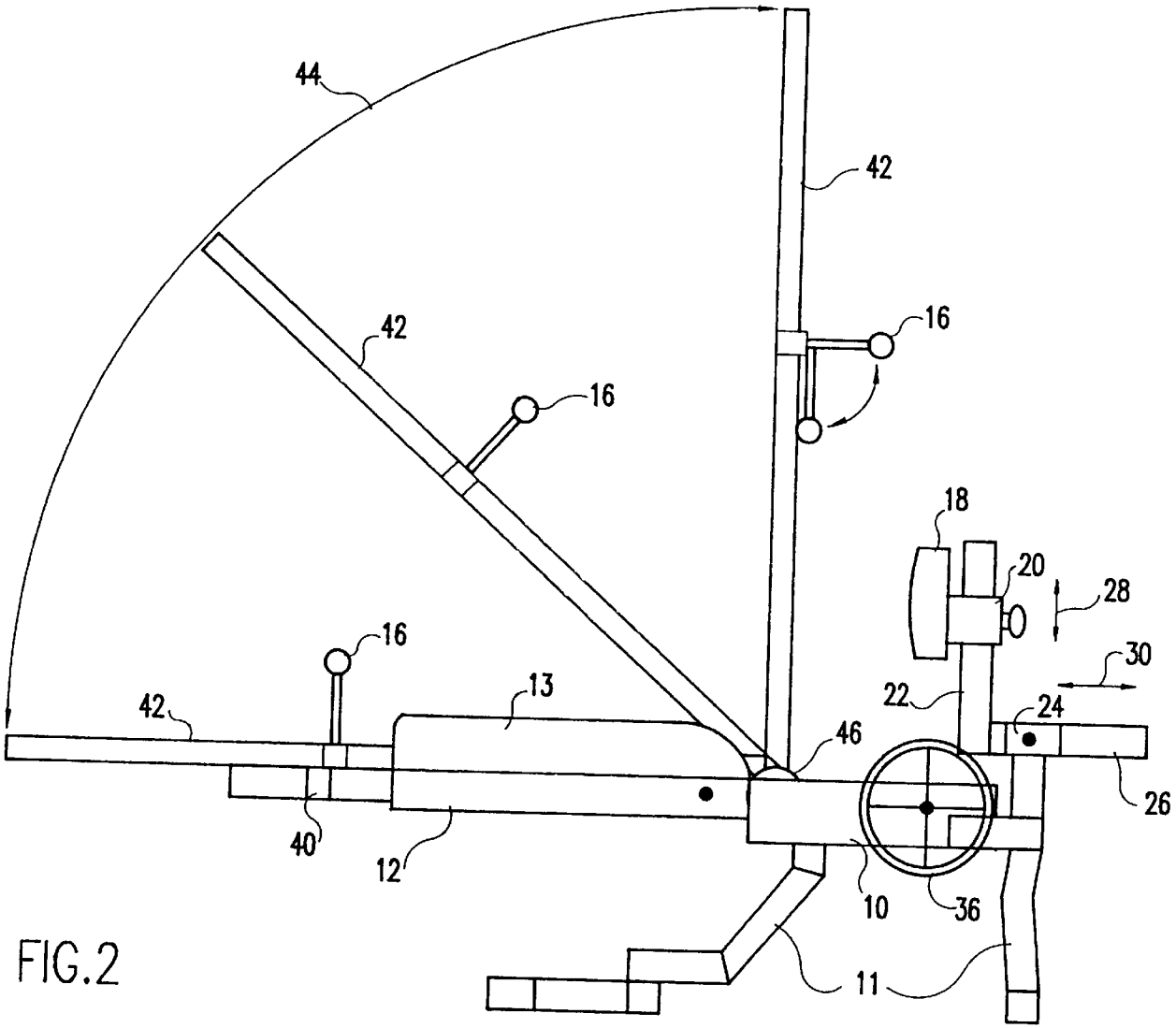
FIG. 2 is a side view of the stretch therapy apparatus of FIG. 1.

FIGS. 1 and 2 schematically show a stretch therapy apparatus according to a first embodiment of this invention. The user sits on platform 10 with his or her legs on leg decks 12 and 14 and hands on handle bar 16. A seat back 18 is selectively adjustable to the user's size by a pin/lock assembly 20 which is connected to seat support bar 22 and a pin/lock assembly 24 which is connected to spacing bar 26 as is indicated by arrows 28 and 30. The seat back 18 may also be located to the left and right of the platform 10 by movement along back locating bar 32.

FIG. 1 shows that the leg decks 12 and 14 move along an arc 34 to stretch the leg muscles of the user. Hand cranks 36 and 38 located on either side of the platform 10 are rotated by the user to cause a gear, chain, pulley, or other suitable mechanism to move the leg decks along the arcuate path. The leg decks 12 and 14 have side walls 13 and 15, respectively, designed to keep the legs on the leg decks 12 and 14 when they are being opened and closed. The stretch therapy apparatus can be constructed such that each of the hand cranks 36 and 38 can simultaneously open leg decks 12 and 14 simultaneously in a symmetrical fashion, or the hand crank 36 can open leg deck 12 and the hand crank 38 can open leg deck 14 individually, or the hand cranks 36 and 38 can be controlled to allow both simultaneous opening of the leg decks 12 and 14 and individual opening of the leg decks 12 and 14. A motor drive (not shown) can be used in place of the hand cranks 36 and 38 to allow motorized opening and closing of the leg decks 12 and 14. The leg decks 12 and 14 may also include joint 40 that allows the deck to bend the foot back towards the user to provide calf stretching.

FIGS. 1 and 2 also show that the stretch therapy apparatus includes a stretching pole 42 which projects from the platform 10. The stretching pole is used to stretch the users back and arm muscles. FIG. 2 shows that the stretching pole 42 can be selectively locked into any angular position along arrow 44 with respect to the platform 10 by orienting and locking means 46. FIG. 1 shows that the stretching pole 42 can also be centrally oriented or at an angular position towards either of the user's legs as is indicated by arrow 48. The user will select an angular position for the stretching pole 42 along arrow 44 and an angular position for the stretching pole 42 along arrow 48, and then will lock the pole 42 into position using locking means 46. In this way, the user can select the degree to which he or she flexes at the waist and the degree to which he or she rotates at the waist.

Figure 13:
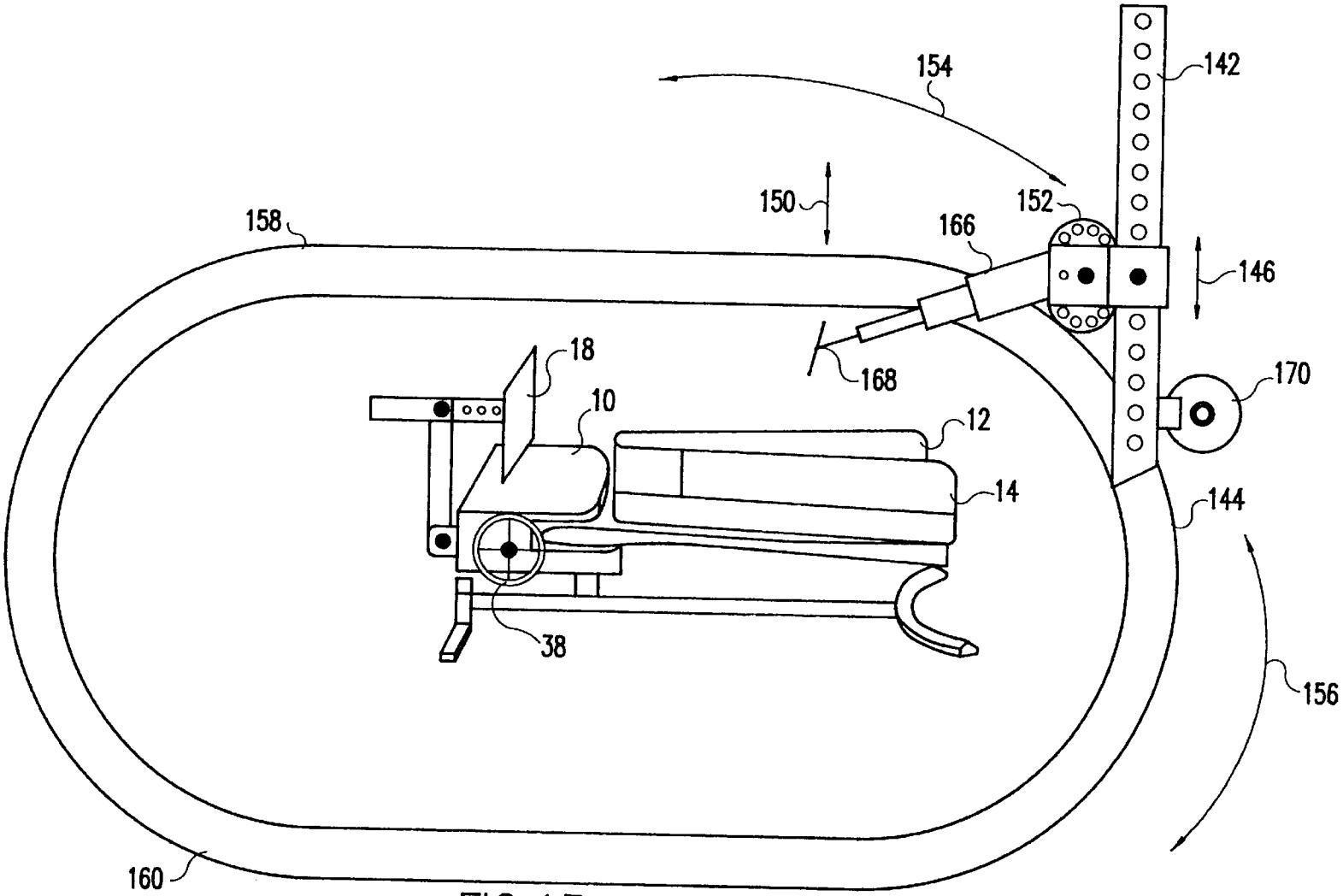
FIG. 13 is an isometric view of the stretch therapy apparatus of FIG. 12 with an attached motor drive configuration.

In operation, the user grasps handle bar 16 after the stretching pole 42 is correctly positioned and moves the handle bar 16 away from his or her body along the length of the pole 42. After the arms and back muscles are fully extended, the handle bar 16 is locked into position so that the back and arm muscles can be stretched. The resulting stretch is far safer and easier than hanging from a chin-up bar since the user's full body weight is not being used to apply the stretching force. As described below in connection with FIG. 4, a motor drive mechanism may also be employed to move the handle bar 16 up and down the stretching pole 42. FIG. 2 also shows that the handle bar 16 can be pivotally connected to the stretching pole 42 to allow a more ergonomic sitting arrangement when stretching. In addition, as shown in FIG. 13, the pole 42 can telescoping such that segments of the pole retract within one another. As will be discussed infra, means, such as a motor, hydraulic pump or other mechanism, can be provided for controlled in and out movement of the segments of the pole 42. By using the stretching pole 42 in combination with leg decks 12 and 14, a wide variety of muscle groups can be stretched with the stretch therapy apparatus. For example, the user will stretch different muscle groups by spreading his or her legs and stretching forward from the waist, than if the user stretched to the left or right with his legs spread.

While FIGS. 1 and 2 show the stretching pole 42 extending from the platform 10, it should be understood that the pole 42 can extend from the support structure of the stretch therapy apparatus or be free standing.

As shown in FIG. 2, the platform 10 can be supported by one or more legs 11. These legs can be fixed or can include means (not shown), is such as a motor, hydraulic pump or other mechanism, for adjusting the tilt of the stretching apparatus. The ability to adjust the angle of the stretching apparatus can increase the stretching effect for the user.

Figure 3A:
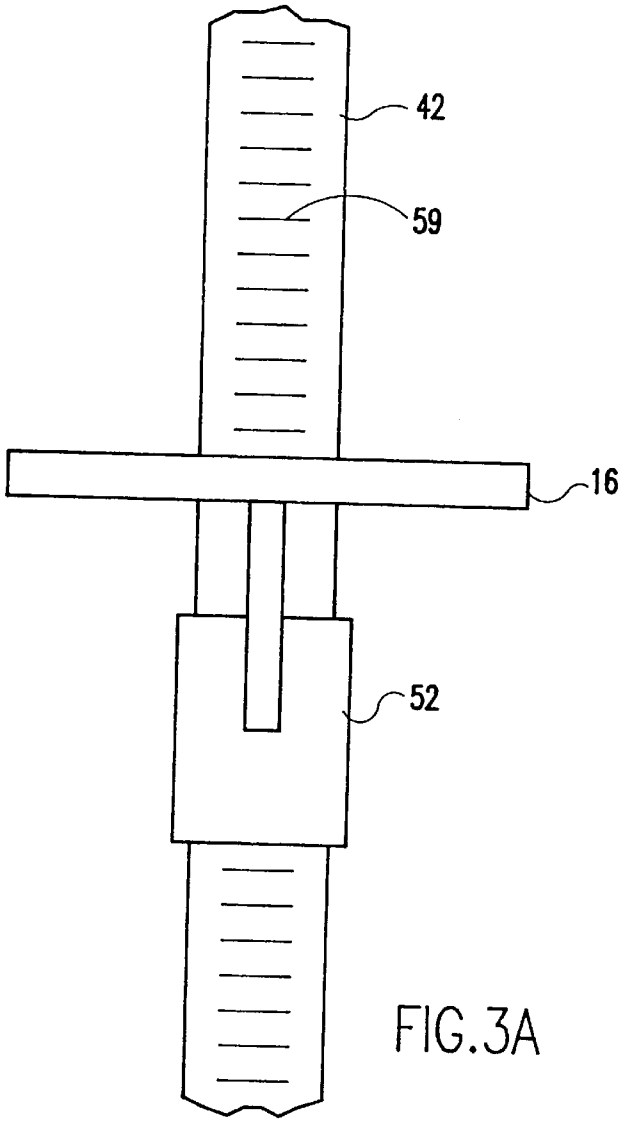
FIG. 3*a* is a detail front view of the embodiment of the hand grip/pole assembly shown in FIG. 3.
Figure 3:
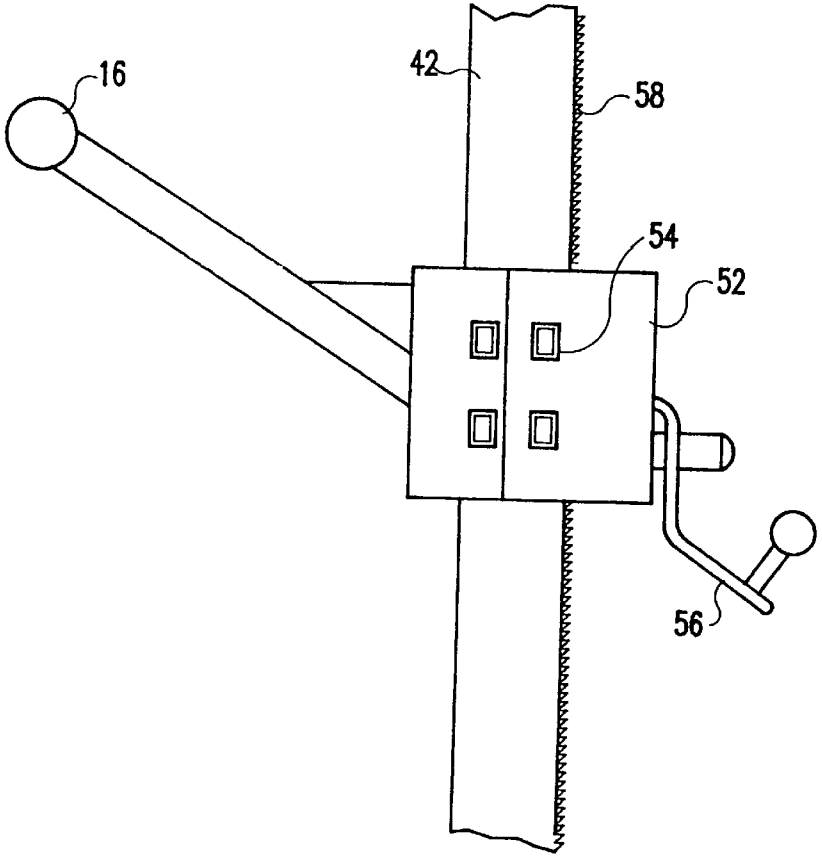
FIG. 3 is a detail side view of one embodiment of the hand grip/pole assembly of the stretch therapy apparatus of FIG. 1 where the hand grip is moved up and down the pole by the user and is held in place at a desired location on the pole using a ratchet mechanism to allow for stretching.
Figure 4:
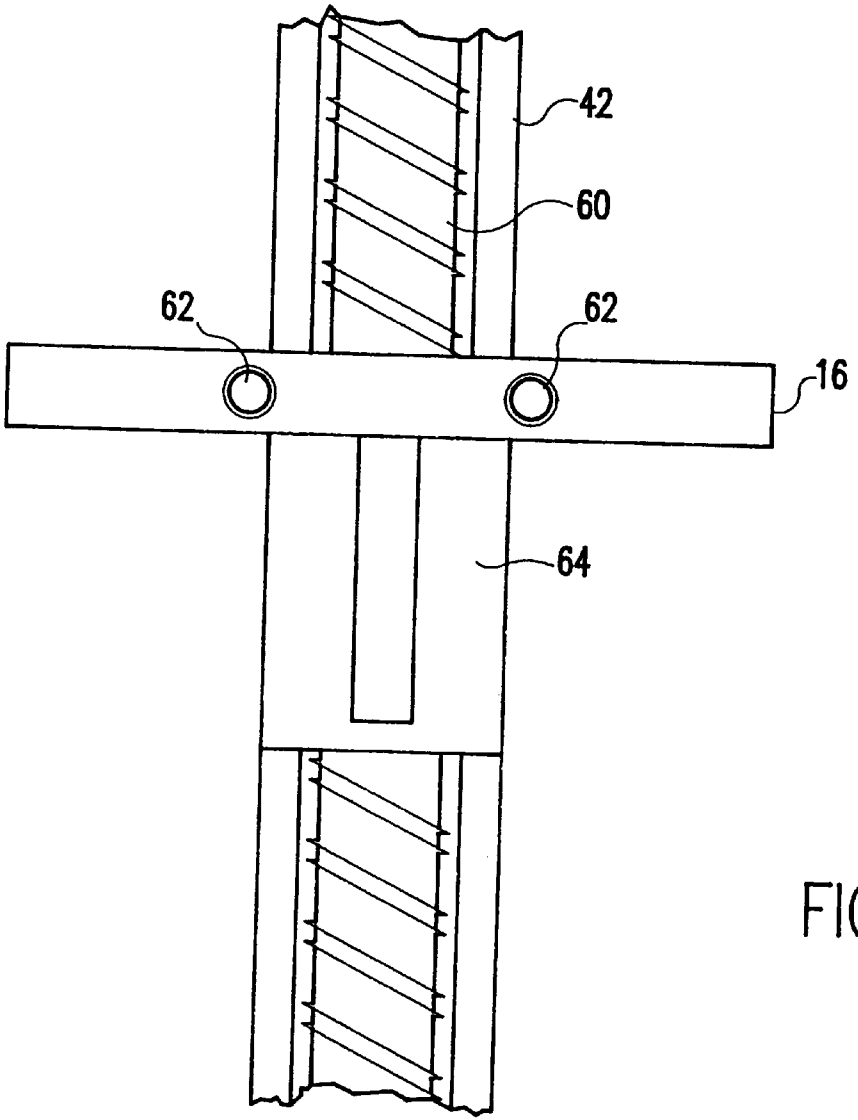
FIG. 4 is a detail view of another embodiment of the hand grip/pole assembly of the stretch therapy apparatus of FIG. 1 where the hand grip is moved up and down the pole by a drive mechanism.

FIGS. 3 and 4 illustrate alternative mechanisms for moving the handle bar 16 along the length of the stretching pole 42. In FIGS. 3 and 3*a*, a slide 52 with wheels 54 or other means moves up the pole 42 as the user extends his or her arms. Once the arms are fully extended, the handle bar 16 is held in position using a ratchet assembly 56 that interlocks with teeth 58. After stretching, the user will let go of the handle bar 16, and pull on the handle of the ratchet assembly 56 so that the handle bar 16 may be moved back down the pole towards the user. FIG. 3*a* provides a detailed front view he stretching pole 42 which can be configured to include visual indicia 59 of the location of the handle bar 16 on the stretching pole 42. The visual indicia can be used by the user or a therapist to monitor the progress of the user. While FIG. 3 shows a ratchet mechanism for locking the handle bar 16 in position on the stretching pole 42, it should be understood that several other mechanisms can be used within the practice of the invention. In FIG. 4, a screw drive 60 is positioned inside the stretching pole 42. The user will depress a button 62 on the handle bar 16 which will direct a motor (not shown) to rotate the screw 60. The slide assembly 64 will move up the length of the sliding pole 42 as long as the button 62 is depressed and the handle bar 16 will be held in position once the user's arms are fully extended to allow a stretching exercise. After stretching for a period of time, the slide assembly 64 will be moved to a new location on the pole under motor control. Alternatively, the slide assembly 64 will be selectively disengageable from the screw 60 to move it to a new location on the pole 42. While FIG. 4 shows a screw drive mechanism for moving and locking the handle bar 16 in position on the stretching pole 42, it should be understood that other mechanisms such as chains, pulleys, etc., can be used to achieve motorized positioning of the handle bar 16 within the practice of this invention.

Figure 5:
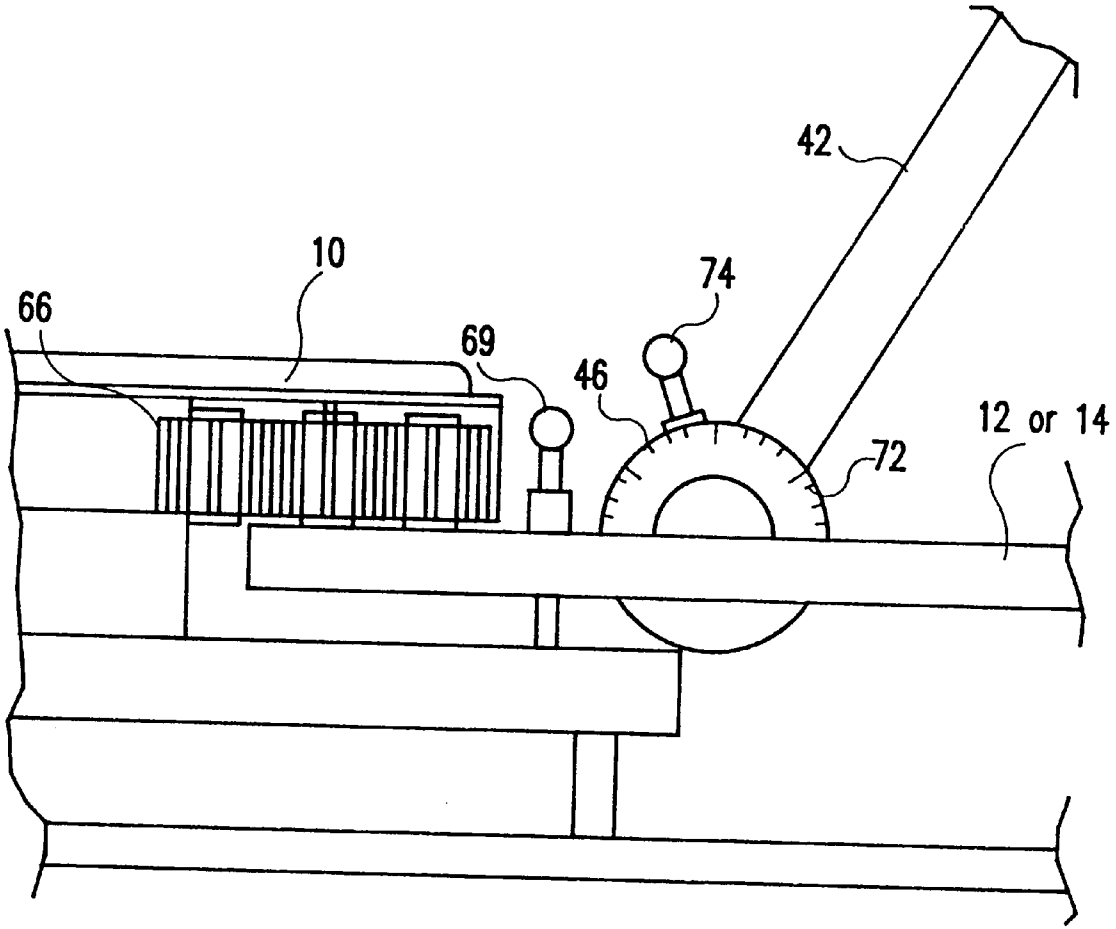
FIG. 5 is a detail view of one embodiment of a pole orienting mechanism together with the gear mechanism for moving the leg decks for the stretch therapy apparatus of FIG. 1.

FIG. 5 shows a gear mechanism 66 positioned under the platform 10 can be used to drive the leg decks 12 and 14 apart. Preferably, the gear mechanism allows for very fine adjustments to the angular orientation of the leg decks. With simultaneous reference to FIGS. 1 and 5, it would advantageous to have the hand cranks 36 and 38 open the leg decks 12 and 14 approximately one half to two degrees per full revolution. If the leg decks were allowed to open five degrees or more per revolution, the user would not be able to widen his legs as accurately or as safely. As the user becomes more proficient, fine incremental increases in the angular degree of leg stretching will become more important to him or her. It should be understood that other mechanisms can be used in place of gears 66; however, gears 66 are preferred since they are more readily adapted to achieve precise control of the degree of leg deck opening.

Figure 6:
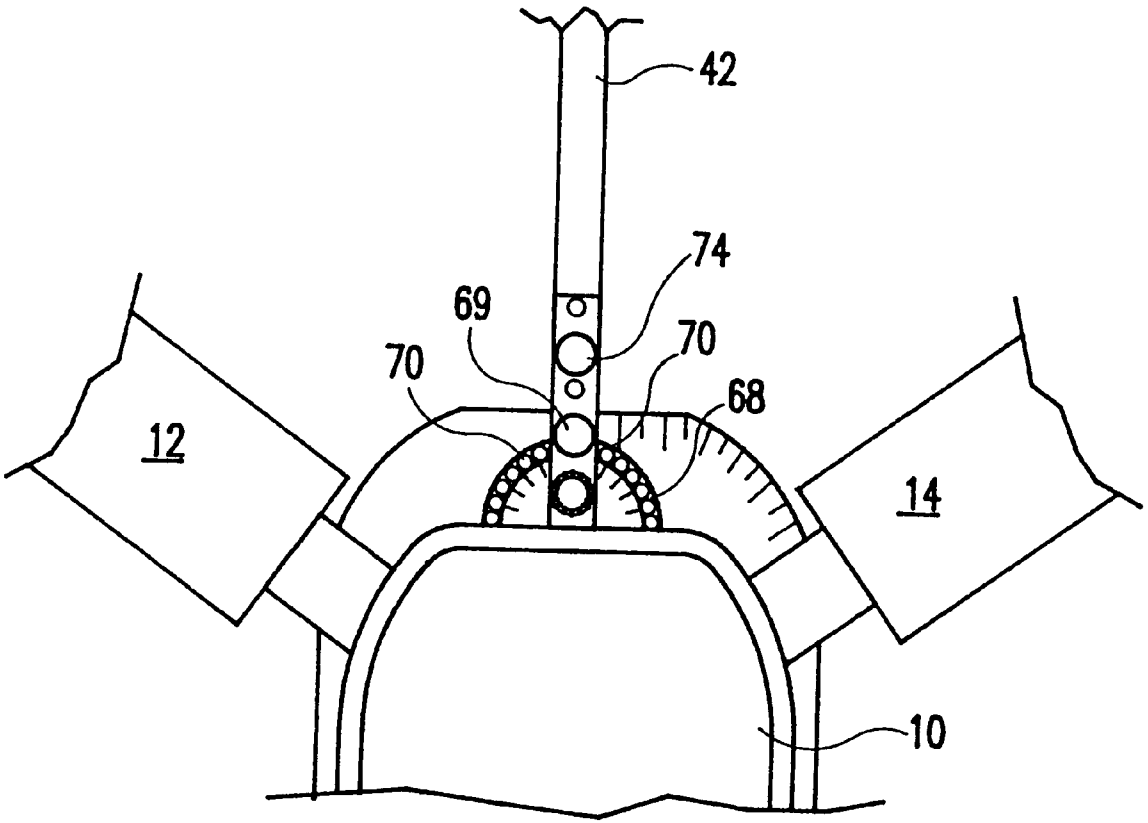
FIG. 6 is a detail view of the leg deck orientation indicia of the stretch therapy apparatus of FIG. 1.

FIG. 6 shows indicia 68 on the platform 10 that provides the user with positive feedback on the degree of leg opening achieved. The indicia 68 may also be used by an attending trainer or therapist to track the progress of the user. FIG. 6 also shows a pin/lock mechanism used for orienting the stretching pole 42 at a desired angular orientation with respect to platform 10. Specifically, the pole 42 will be moved to a desired location and the pin 69 will be inserted into opening 70 to lock the pole in position.

With reference back to FIG. 5, it can be seen that the pole 42 orienting and locking assembly 46 is also provided with indicia 72 that allows the user to precisely select the angle of the pole 42 relative to the platform 10. A pin/lock mechanism 74 acts in conjunction with the locking assembly 46 to maintain the pole 42 in the selected angular orientation. Positioning the pin/lock mechanism 74 directly in front of the user allows for easier operation; however, other configurations can be used within the practice of this invention. While a pin/lock mechanism 74 is shown in FIG. 5, it should be understood that many other mechanisms can be employed.

Figure 7A:
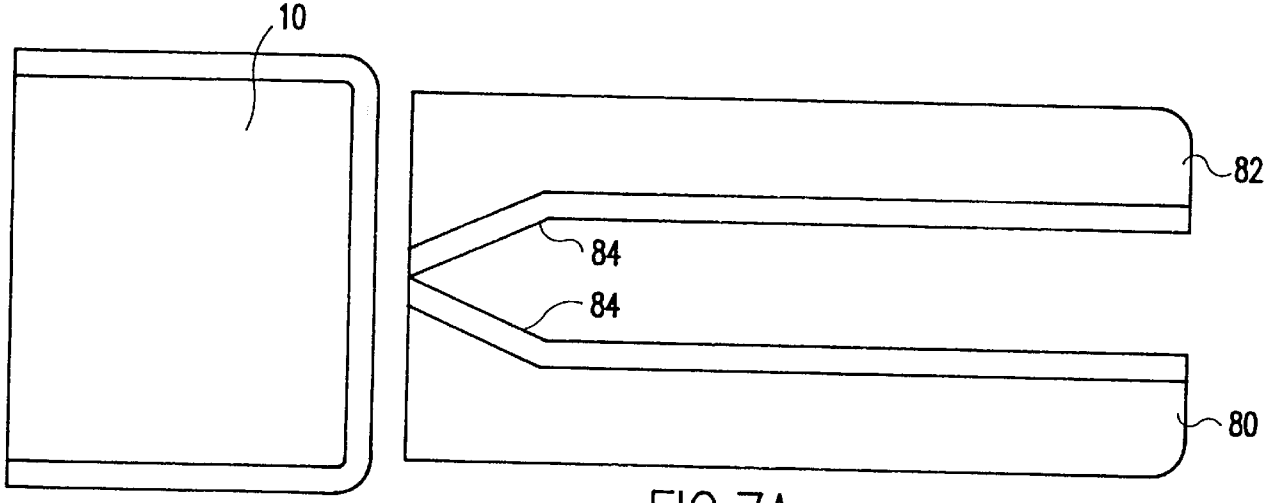
FIGS. 7*a*, 7*b*, and 7*c* are plan, isometric, and cross-sectional views, respectively, of a leg deck structure for use in a stretch therapy apparatus according to the first, second, third and sixth embodiments.
Figure 7B:
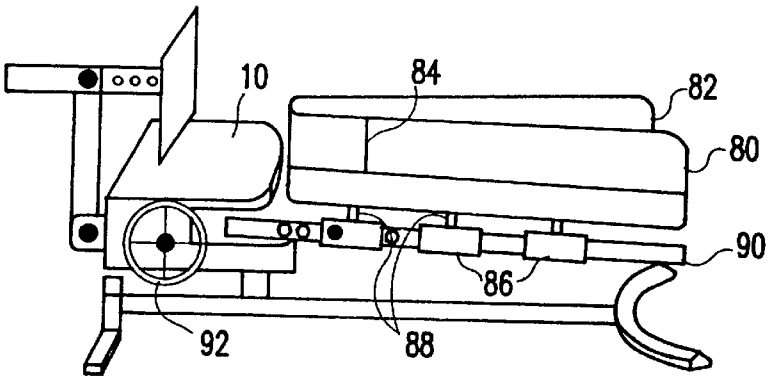
Figure 7C:
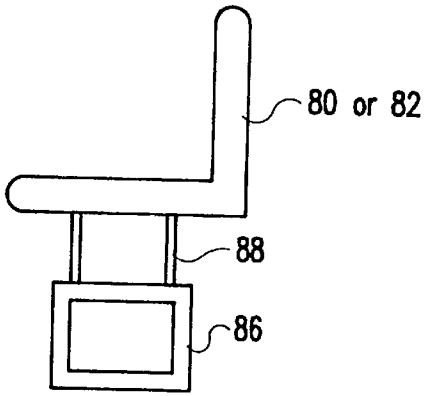

FIGS. 7*a*–7*c* illustrate an enhancement to the leg decks used in the stretch therapy apparatus that will reduce undue stress on the knees of the user. FIG. 7*a* shows 80 and 82 each have a bend region 84. In the preferred embodiment, the bend region 84 is positioned approximately 6 to 12 inches along the leg decks 80 or 82, starting from the end closest to the platform 10. Furthermore, it is preferred that the inner angle of the bend region be in the range of approximately 120 degrees to 180 degrees and it is most preferred that the angle is approximately 150 degrees. FIGS. 7*b* and 7*c* show that the leg decks 80 or 82 are secured to sliding tubular connectors 86 by risers 88. The tubular connectors 86 travel on poles 90 associated with each leg deck 80 or 82. As the legs are separated by rotation of the crank 92, the leg decks 80 and 82 are permitted to slide along the poles 90 a short distance. The sliding motion of the leg decks 80 and 82 along with the bend region 84 reduce the amount of stress on the user's knees as the leg decks 80 and 82 are opened and closed compared to leg decks which do not slide and do not have a bend region.

Figure 8:
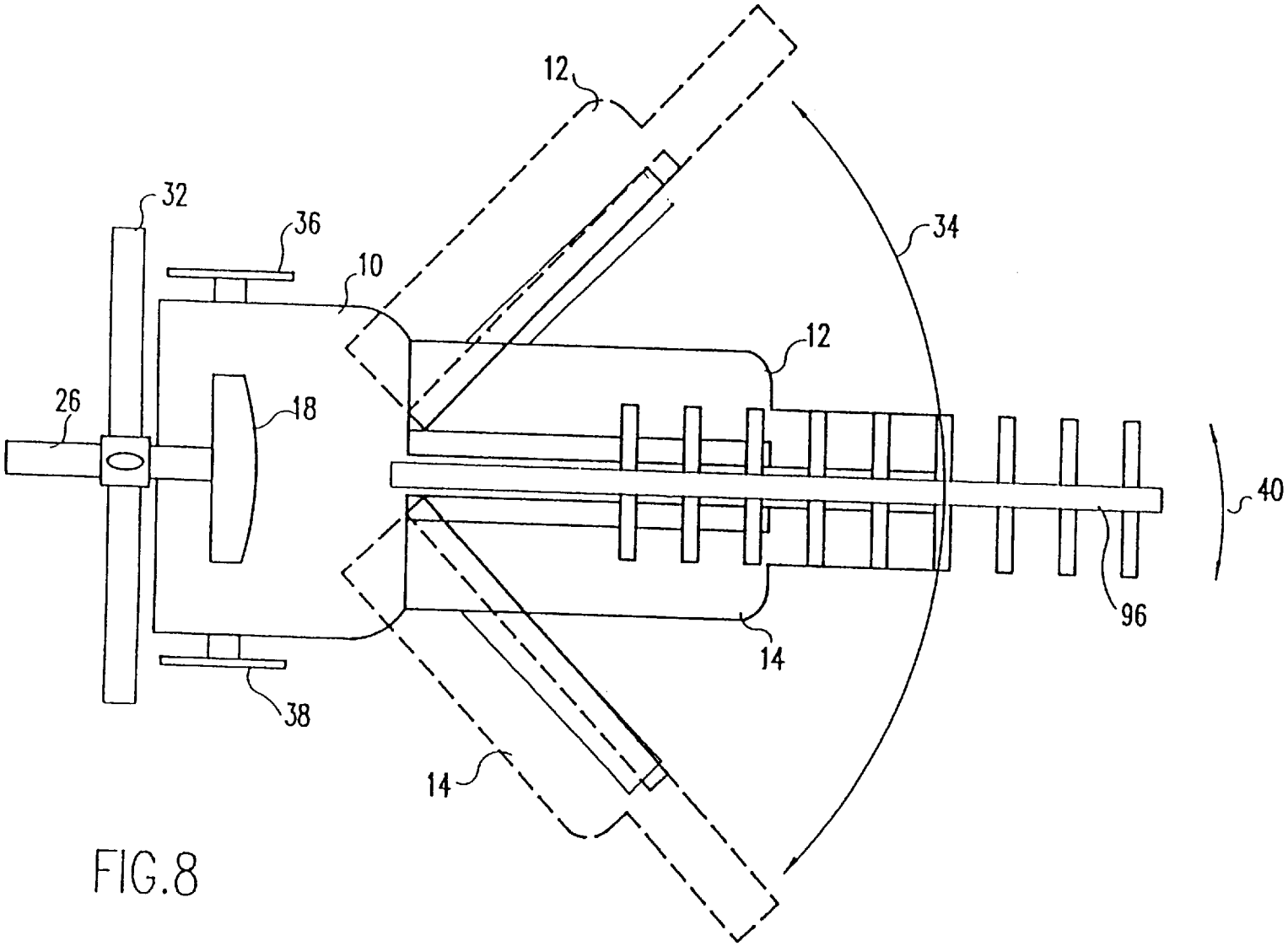
FIG. 8 is a plan view of a stretch therapy apparatus similar to that shown in FIG. 1, but where ladder rungs are substituted for the moveable hand grip assembly.

FIG. 8 shows a stretch therapy apparatus similar to that shown in FIG. 1. Therefore, like elements have been indicated with the same numbers on both Figures. In FIG. 8, the stretching pole 96 has a plurality of ladder rung projections 98 along its length. For all other purposes, the stretch therapy apparatus of FIG. 8 works in the same fashion as that described in FIG. 1 (e.g., the leg decks 12 and 14 open and close, and the stretching pole 96 can be oriented in any selected vertical inclination and at any selected horizontal angle). In operation, the user will orient the stretching pole 96 as described above. Then, in order to perform a stretching exercise, he or she will reach for a pair of the ladder rung projections 98. Once the ladder rung projections 98 are grasped, the user will hold the stretch for a period of time. The user can track his or her progress by monitoring the ladder rung projection he or she has grasped for the stretch.

Figure 9:
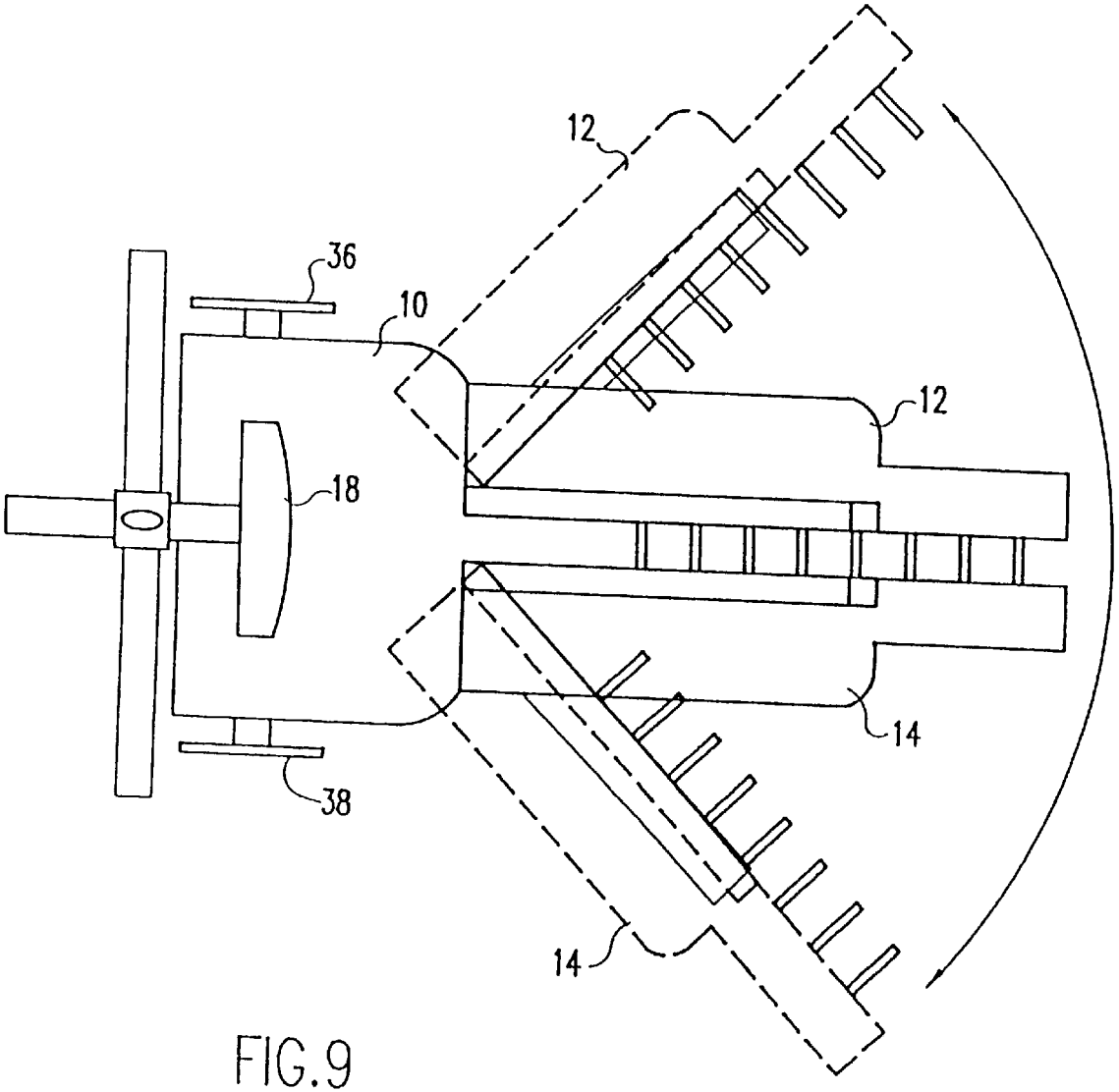
FIG. 9 is a plan view of a stretch therapy apparatus similar to that shown in FIG. 1, but where the pole is eliminated and ladder rungs are positioned on each of the leg decks.

FIG. 9 shows a stretch therapy apparatus where the stretching pole has been eliminated. However, stretching of the user's back and arms is still accomplished using ladder rung projections 100 positioned along the length of the leg decks 12 and 14. In the design shown in FIG. 9, the user will open the leg decks 12 and 14 to the desired angle, and will then reach for a ladder rung on one or the other leg deck. After grasping the ladder rung, the user will hold the stretch for a period of time. While not shown in FIG. 9, it should be understood that a sliding handle bar mechanism like that described in conjunction with FIGS. 1–4 could be built into each leg deck 12 and 14 in place of the ladder rungs 100.

Figure 10:
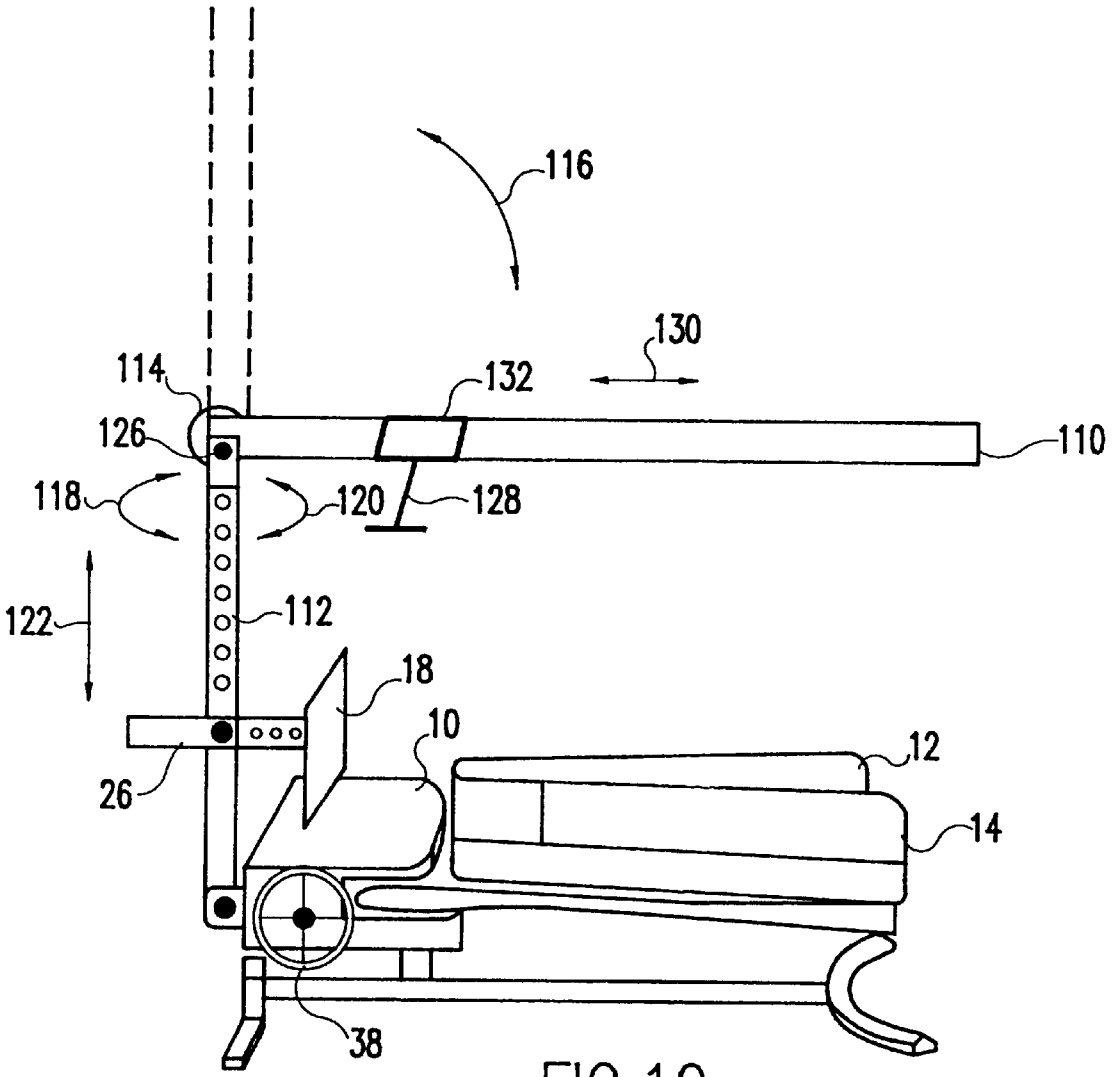
FIG. 10 is a side view of a stretch therapy apparatus according to a second embodiment of this invention.

FIG. 10 shows a second embodiment of the stretch therapy apparatus where the stretching pole 110 is positioned above the user's seated position. The leg decks 12 and 14 operate in the same manner as discussed above in conjunction with FIGS. 1 and 2; therefore, the same numbering scheme for like elements has been used. The stretching pole 110 is connected to support pole 112 by a pole orienting mechanism 114. The pole orienting mechanism 114 allows the stretching pole 110 to pivot vertically along arc 116 and to rotate about the support pole 112 along arcs 118 and 120. The height of the stretching pole 110 above the platform 10 is adjustable as indicated by arrow 122. In operation, the user orients the stretching pole 110 to a selected vertical angle and horizontal angle (e.g., the pole 120 is oriented in three dimensional space in the same way as described above in conjunction with FIGS. 1 and 2) and then locks the pole into position using locking means 126. The user then grasps the handle bar 128 and moves it along the stretching pole 110 as indicated by arrow 130 until his or her arms are fully extended. A ratchet or other suitable mechanism associated with the sliding member 132 will hold the handle bar 128 in position as the user performs his or her stretching exercise. An advantage of the stretch therapy apparatus of FIG. 10 is that it allows the user to perform a stretch directly above his or her head while in the seated position on platform 10.

Figure 11:
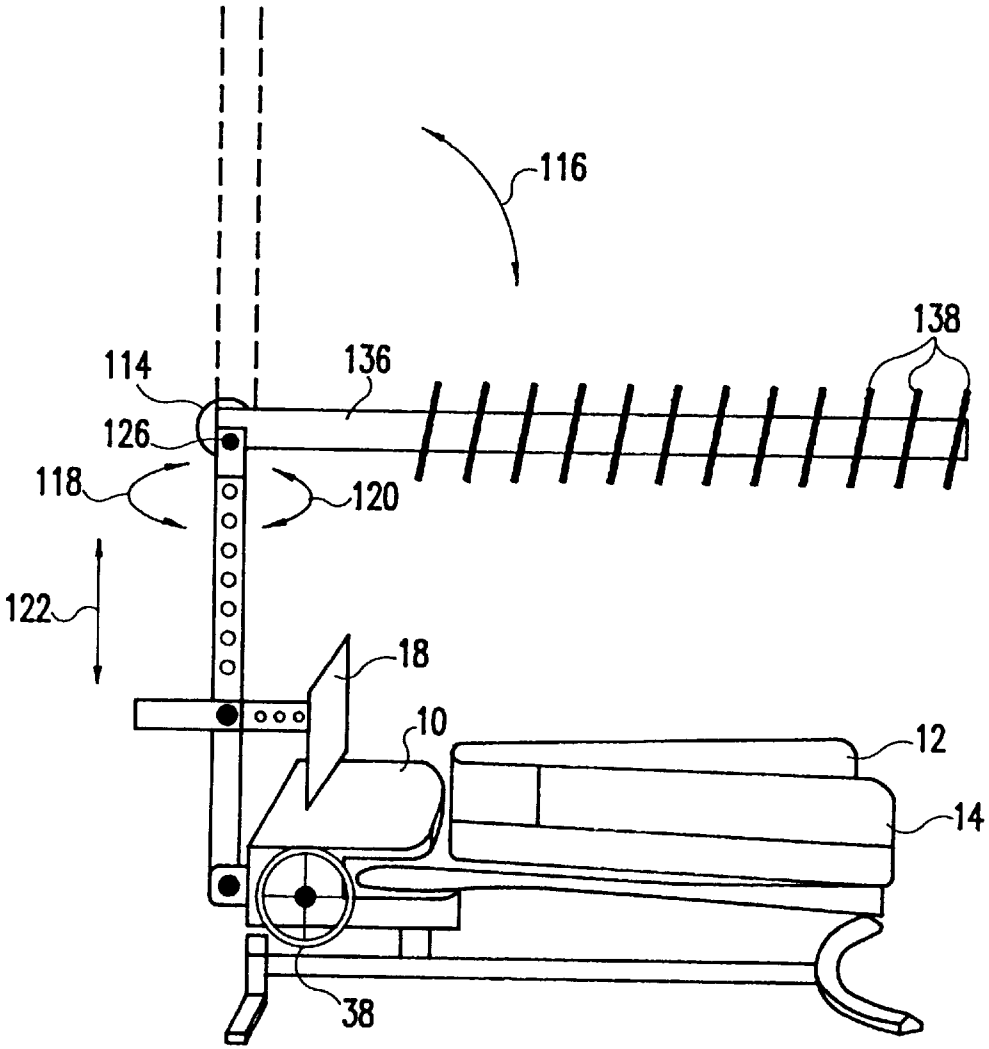
FIG. 11 is a side view of a stretch therapy apparatus similar to that shown in FIG. 10, but where ladder rungs are substituted for the moveable hand grip assembly.

FIG. 11 shows a stretch therapy apparatus identical to that shown in FIG. 10, except for the stretching pole 136; hence, like numerals have been used to indicate like elements. The stretching pole 136 has been modified by using a plurality of ladder rung projections 138 instead of a sliding handle bar. As described above, the user will orient the stretching pole 136, then grasp a pair of the ladder rung projections 138 to perform a stretching exercise.

Figure 12:
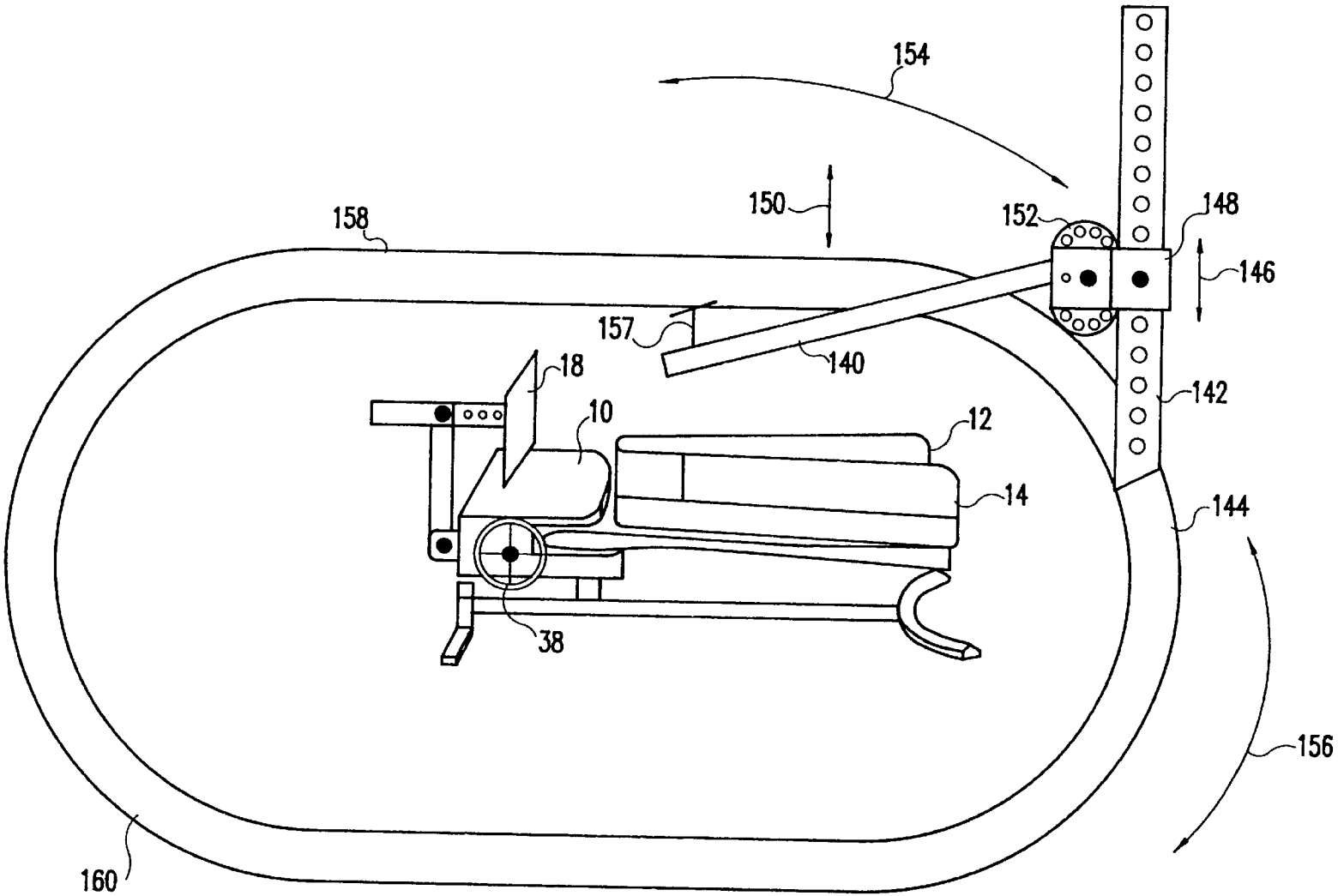
FIG. 12 is an isometric view of a stretch therapy apparatus according to a third embodiment of this invention.

FIG. 12 shows a third embodiment of the stretch therapy apparatus. As discussed in conjunction with the second embodiment shown in FIGS. 10 and 11, the leg decks 12 and 14 operate in the same manner as described above in conjunction with the embodiment of FIG. 1; therefore, like numerals have been used to indicate like elements. The chief difference in the stretching apparatus shown in FIG. 12 is that the stretching pole 140 is separate from the platform 10. The stretching pole 140 is connected to a support pole 142 that is moveable around a track 144 that encircles the machine. The height of the stretching pole 140 is adjustable as indicated by arrow 146 and can be set by lock mechanism 148. The vertical angular orientation of the stretching pole 140 is also adjustable as indicated by arrow 150 and can be set by lock mechanism 152. In operation, the user sets the height and orientation of the stretching pole 140, and the location of the pole is then adjusted by movement within the track 144 as indicated by arrows 154 and 156. An advantage of the configuration shown in FIG. 12 is that the user will be able to rotate about his or her torso to a greater degree while performing stretches than is possible with the first embodiment of the stretch therapy apparatus. For example, while the user's legs are spread he or she can rotate his or her torso to grasp handle bar 157 on stretching pole 140 when the stretching pole 140 and support pole are located at points 158 or 160 in the track 144. As discussed above in connection with the previous embodiments, the user grasps the handle bar 157 and moves it along the stretching pole 140 until his or her arms are fully extended. A ratchet or other suitable mechanism will hold the handle bar 157 in position as the user performs his or her stretching exercise.

FIG. 13 shows a stretch therapy apparatus identical to that shown in FIG. 12, except for the stretching pole 166; hence, like numerals have been used to indicate like elements. The stretching pole 166 has been modified to be of telescoping construction. The user will grasp the handle bar 168 after the stretching pole 166 is oriented by adjusting the height on support pole 142 and vertical inclination 146 using lock mechanism 152. The user will then fully extend his or her arms so that segments of the telescoping stretching pole 166 retract within one another. A means 170, which can be a motor, hydraulic pump, or other mechanism, can be provided to allow controlled movement of the segments in and out in the telescoping stretching pole 162. After the user's arms are fully extended, the telescoping stretching pole 166 is locked so that the user can perform a stretching exercise for a short period of time.

Figure 14:
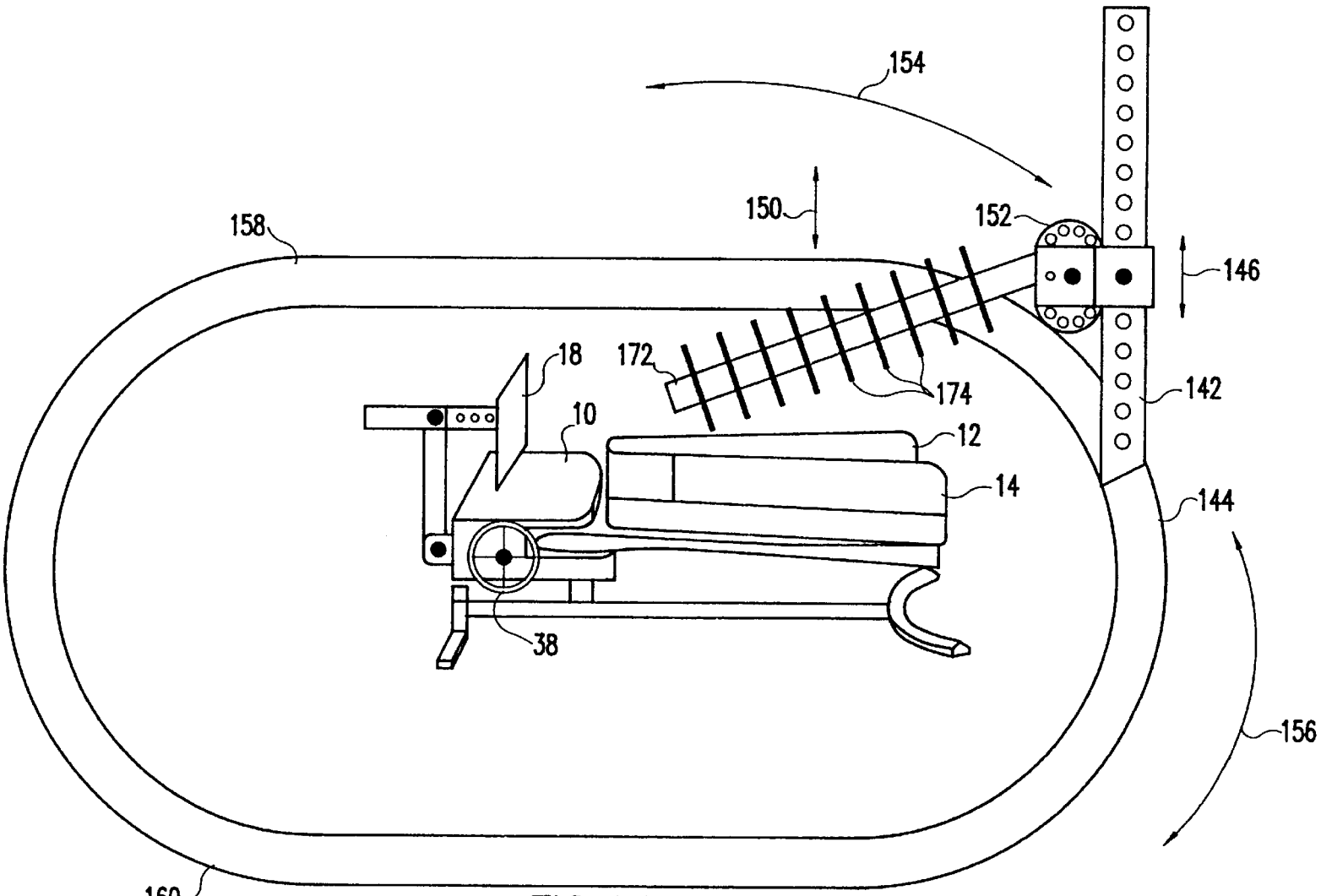
FIG. 14 is an isometric view of a stretch therapy apparatus similar to that shown in FIG. 12, but where ladder rungs are substituted for the moveable hand grip assembly.

FIG. 14 shows a stretch therapy apparatus identical to that shown in FIG. 12, except for the stretching pole 172; hence, like numerals have been used to indicate like elements. The stretching pole 172 has been modified by using a plurality of ladder rung projections 174 instead of a sliding handle bar. As described above, the user will orient the stretching pole 172, then grasp a pair of the ladder rung projections 174 to perform a stretching exercise.

Figure 15:
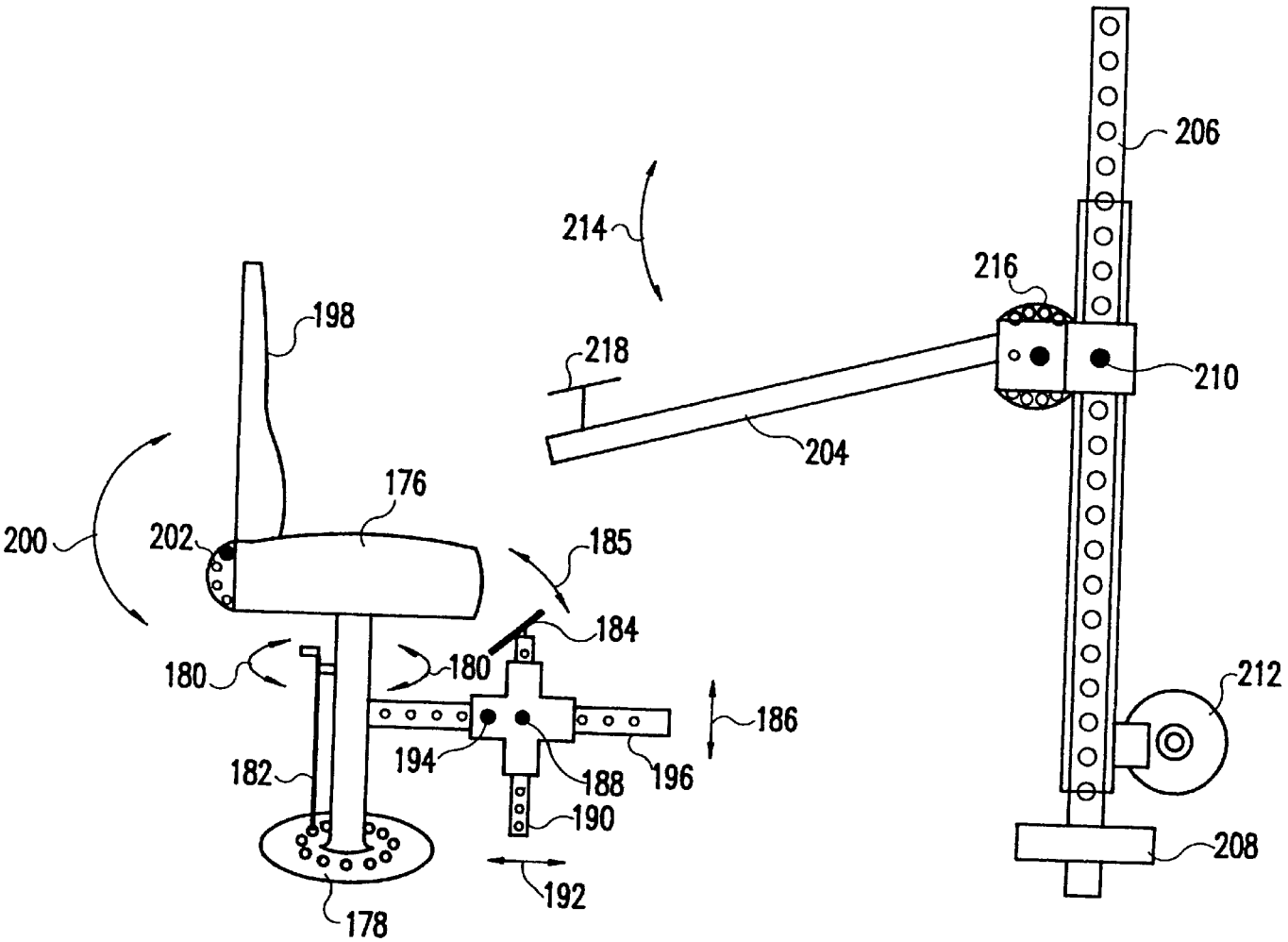
FIG. 15 is a side view of a stretch therapy apparatus according to a fourth embodiment of this invention.

FIG. 15 shows a fourth embodiment of the stretch therapy apparatus. A user is seated on chair 176. The chair 176 swivels about base 178 as indicated by arrows 180 and can be selectively locked into position using a pin/lock mechanism 182 that can comfortably be operated by the user while in the chair 176. The user's feet are positioned on foot pedestal 184. The height of the foot pedestal 184 can be adjusted as indicated by arrow 186 using a pin/lock mechanism 188 in combination with vertical bar 190. The distance the foot pedestal 184 is positioned from the chair 176 is adjustable as indicated by arrow 192 and can be set using a pin/lock mechanism 194 on horizontal bar 196. The foot pedestal 184 can be equipped with a tilting mechanism to tilt the angle of inclination relative to vertical bar 190 so that user's calf and foot muscles are stretched as indicated by arrow 185. The angle of the seat back 198 is adjustable as indicated by arrow 200 using a pin/lock or other suitable mechanism 202. A stretching pole 204 is connected to a support pole 206 positioned in base 208. The height of the stretching pole 204 on support pole 206 can be adjusted using a pin/lock mechanism 210, or may be adjusted using a motor drive 212 or other suitable mechanism. The vertical angle of the stretching pole 204 is adjustable as indicated by arrow 214 using a pin/lock or other suitable mechanism 216. As discussed above, the user will grasp handle bar 218 after he or she has oriented the stretching pole 204 and the seat 176, and will slide the handle bar 218 on stretching pole 204 until his or her arms are fully extended. A ratchet mechanism or the like will then hold the handle bar 218 in position until the user has completed the stretching exercise. The stretch therapy apparatus of FIG. 15 has the advantage of being relatively inexpensive to construct, but still providing an improved arm and back muscle stretching machine that does not put undue force on the muscles and still allows the user with a full range of movement about his or her torso when performing the stretches.

Figure 16:
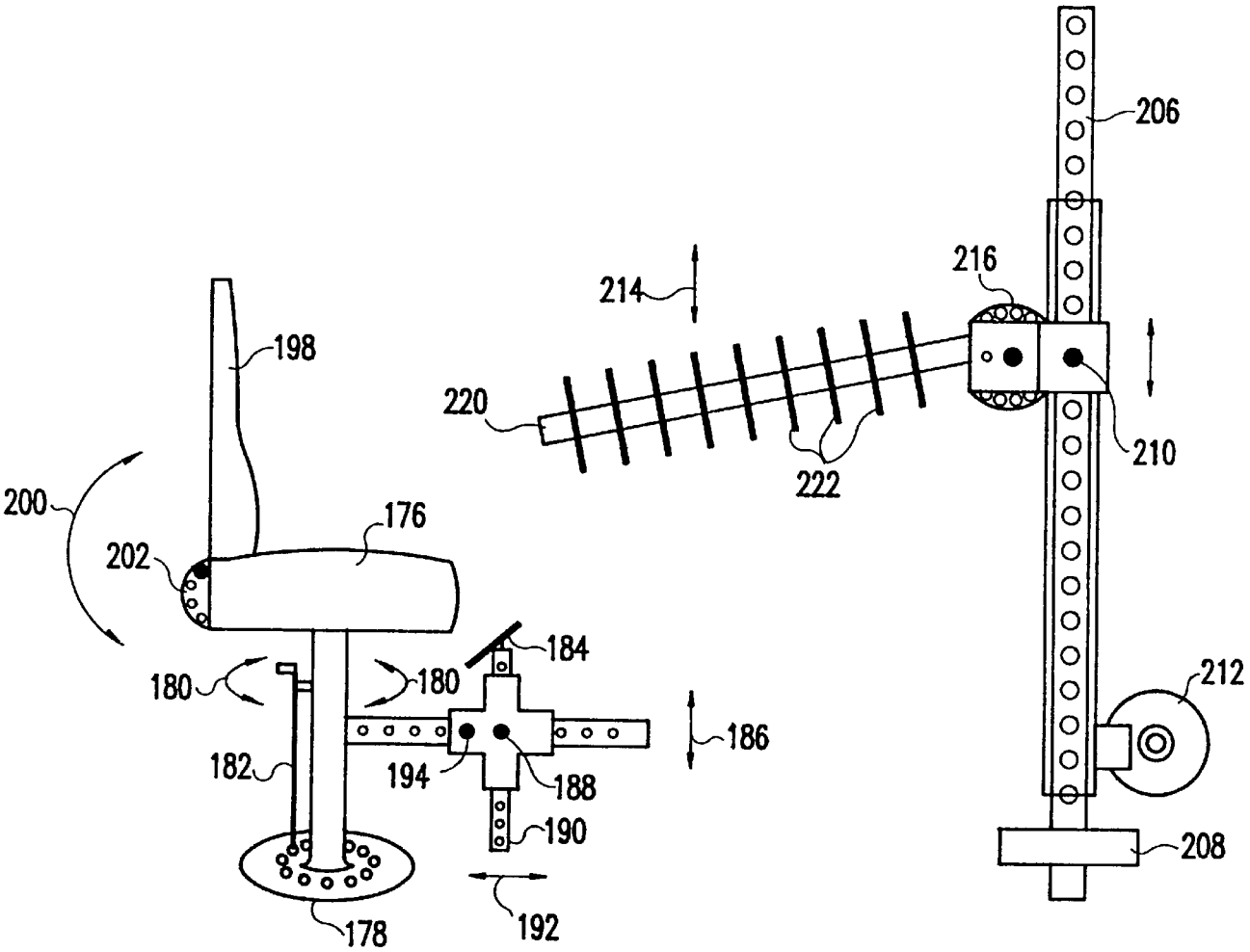
FIG. 16 is a side view of a stretch therapy apparatus similar to that shown in FIG. 15, but where ladder rungs are substituted for the moveable hand grip assembly.

FIG. 16 shows a stretch therapy apparatus identical to that shown in FIG. 15, except for the stretching pole 220; hence, like numerals have been used to indicate like elements. The stretching pole 220 has been modified by using a plurality of ladder rung projections 222 instead of a sliding handle bar. As described above, the user will orient the stretching pole 220 and the seat 176, then grasp a pair of the ladder rung projections 222 to perform a stretching exercise.

Figure 17:
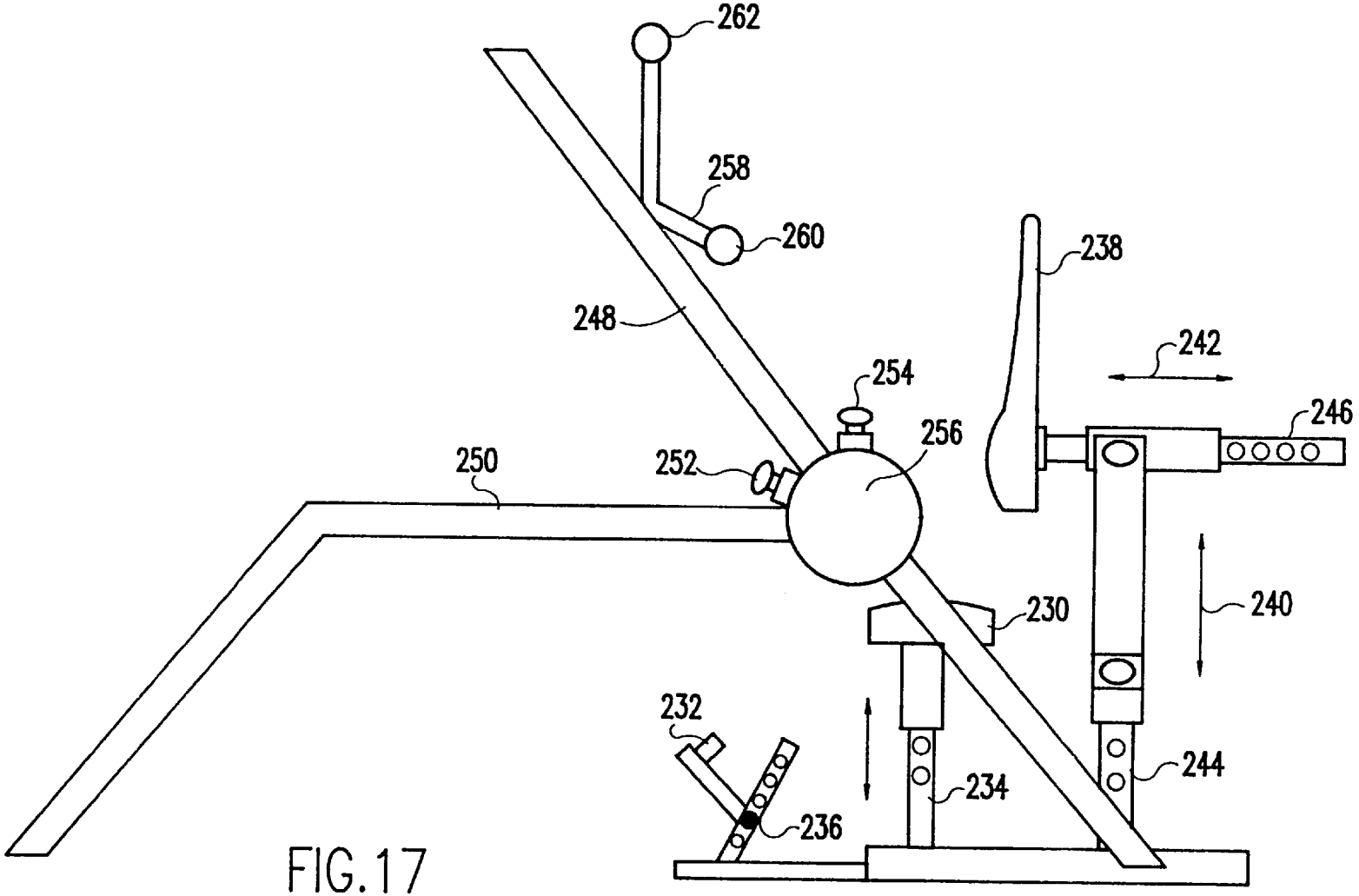
FIG. 17 is a side view of a stretch therapy apparatus according to a fifth embodiment of this invention.

FIG. 17 shows a fifth embodiment of the stretch therapy apparatus. A user sits on platform 230 with his or her feet on pedestal 232. The height of the platform 230 and pedestal 232 are adjustable using pin/lock or other suitable mechanisms that operate in conjunction with support bars 234 and 236, respectively. A seat back 238 is positioned behind the user using both vertical and horizontal adjustments as indicated by arrows 240 and 242, respectively, on vertical support 244 and horizontal support 246. Pin/lock or other suitable mechanisms can be used on the vertical support 244 and horizontal support 246. A stretching pole 248 positioned in front of the user extends from support frame 250. Preferably, the position of the stretching pole 248 on the support frame 250 is adjustable using a pin/lock or other suitable mechanism 252, and the angular orientation of the stretching pole 248 can be adjusted using a pin/lock or other suitable mechanism 254 that operates in conjunction with a stretching pole orienting mechanism 256. Similar to the method described above, a user will orient the stretching pole 248, and then grasp handle bar 258 and slide it along stretching pole 248 until his or her arms are fully extended. The handle bar 258 will then be held in position to allow the user to perform a stretching exercise. The handle bar 258 may be provided with two different grip sites 260 and 262 to provide the stretch therapy apparatus enhanced flexibility. As discussed above with the previous embodiments, ladder rungs (not shown) may be substituted for sliding handle bar 258.

Figure 18:
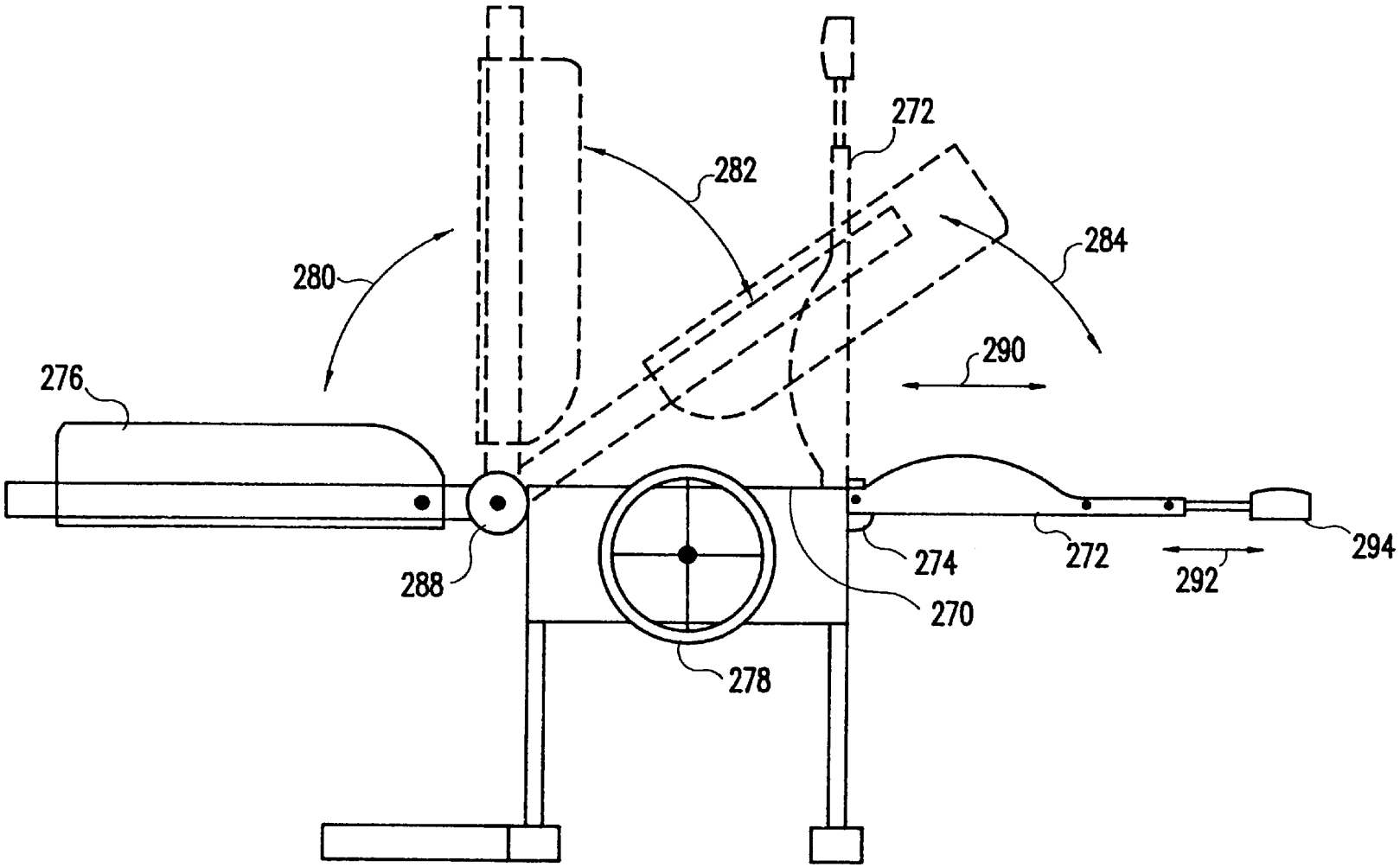
FIG. 18 is a side view of a stretch therapy apparatus according to a sixth embodiment of this invention.

FIG. 18 shows a sixth embodiment of the stretch therapy apparatus. The user is positioned on platform 270 with the seat back 272 up or down. A pin/lock or other suitable mechanism 274 allows the seat back 272 to be positioned at any desired inclination. A separate headrest 294 can be provided with the seat back 272 for the comfort of the user. As indicated by arrow 292, the headrest 294 can be adjusted relative to the seat back 272 to accommodate the user. The user positions his or her legs in leg decks 276 that are similar in construction to those shown in FIGS. 1 and 7. Hand crank 278 or a motorized mechanism is used to raise and lower the leg decks 276 for stretching of the hamstring and gluteus maximus muscles. A major advantage of the sixth embodiment is that the angle of inclination of the leg decks 276 can be adjusted relative to the user as is indicated by arrows 280, 282, and 284. In operation, the leg decks 276 are pivoted using a pivot/lock mechanism 288 or other suitable mechanism to a desired angular orientation and held in that orientation, and the seat back 272 is positioned at a desired angular orientation. Arrow 290 indicates that the seat back 272 can also be moved axially relative to the leg decks 276 to accommodate the user. Once the leg decks 276 and seat back 272 are in position, the user operated the hand crank 278 to raise and lower the leg decks to perform a stretching exercise.

Figure 19:
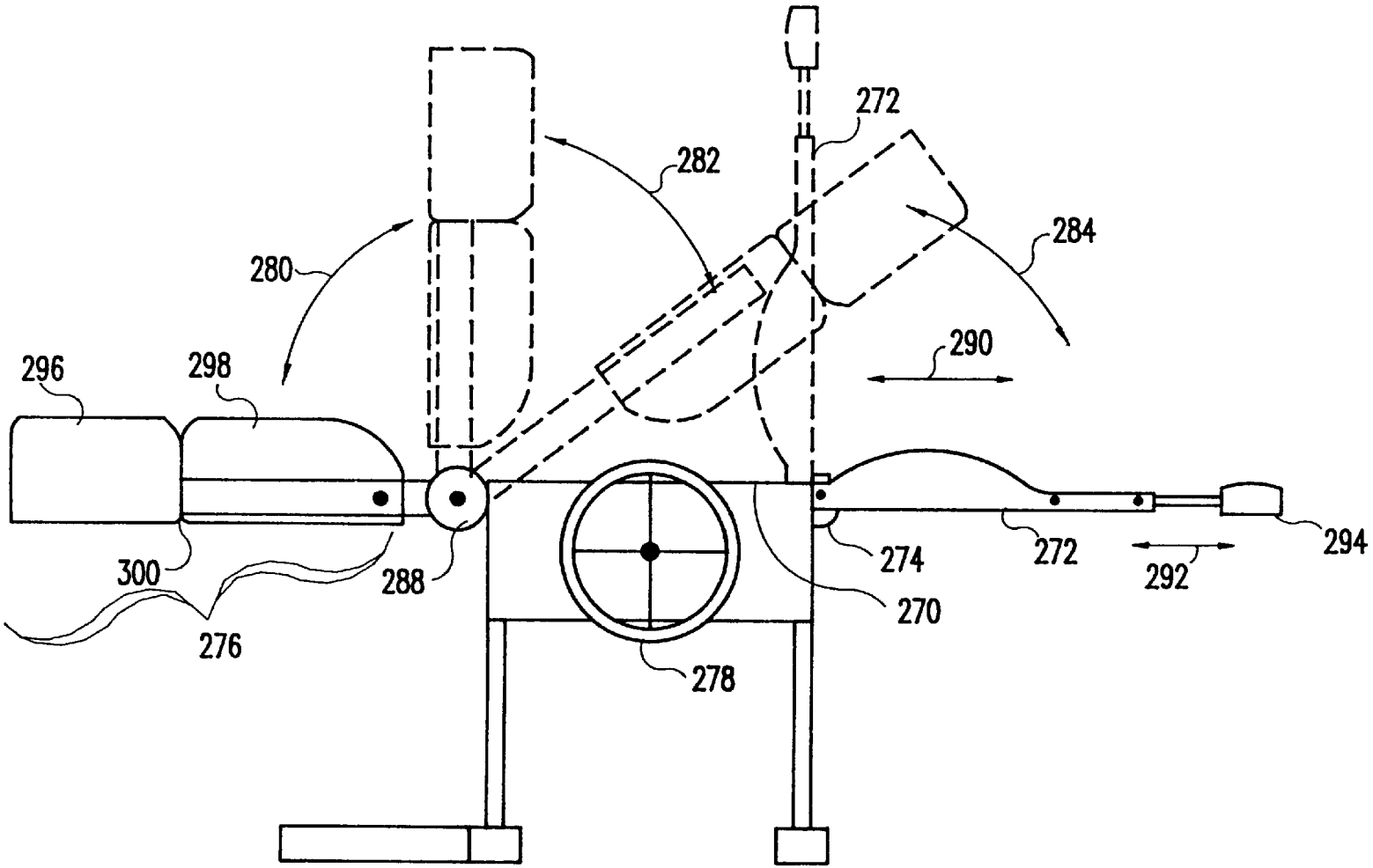
FIG. 19 is a side view of a stretch therapy apparatus similar to that shown in FIG. 18, but where the leg decks includes a lockable joint so that the leg deck can be shortened.

FIG. 19 shows a stretch therapy apparatus similar to that shown in FIG. 18, except for the leg decks 276, therefore, similar numerals have been used to indicate like elements. The leg decks 276 have been modified to include two pieces 296 and 298 which are connected by a pivot/lock mechanism 300. The user can thereby lock the leg decks 276 in angled configurations to allow for stretching of the hamstring and gluteus maximus muscles without full extension of the user's legs.

While the invention has been described in terms of its preferred embodiments, those skilled in the art will recognize that the invention can be practiced with modification within the spirit and scope of the appended claims.

We claim:

1. A stretching apparatus, comprising:

a seat;

a pole positioned in front of the seat; and a handle being slidably connected to said pole such that the handle freely slides in a first direction substantially along a length of said pole and generally away from said seat, and is biased against the movement in a second opposite direction.

2. The stretching apparatus of claim 1 wherein said pole is constructed from telescoping elements.

3. The stretching apparatus of claim 1 wherein said handle is movable along a length of said pole and is lockable in different positions along said length of said pole.

4. The stretching apparatus of claim 1 further comprising a means for altering an angular orientation of said pole with respect to said seat.

5. The stretching apparatus of claim 1 wherein said handle is positionable on said pole at locations positioned above said seat.

6. A stretching apparatus as recited in claim 1 further comprising a pair of leg supports positioned adjacent said seat, said leg supports being rotatable in opposite directions from a front position in front of said seat to side positions at opposite sides of said seat.

7. The stretching apparatus as recited in claim 6 wherein said leg supports can be held at any position between said front position and said side positions.

8. The stretching apparatus of claim 1 further comprising locking means for locking the handle on said pole.

9. The stretching apparatus of claim 8 wherein said locking means comprises a rachet assembly.

10. The stretching apparatus of claim 1 wherein said handle is mounted to a slide mechanism, said slide mechanism includes wheels that contact and slide along the length of said pole.

* * * * *